United States Patent [19]

Yamamoto

[11] 4,308,531

[45] Dec. 29, 1981

[54] LIGHT TRANSMISSION TYPE SMOKE DETECTOR

[75] Inventor: Katsura Yamamoto, Tokyo, Japan

[73] Assignee: Nittan Company, Ltd., Tokyo, Japan

[21] Appl. No.: 206,225

[22] Filed: Nov. 12, 1980

[30] Foreign Application Priority Data

May 22, 1980 [JP] Japan ..... 55-67167

[51] Int. Cl.[3] ..... G08B 17/10

[52] U.S. Cl. ..... 340/630; 250/573

[58] Field of Search ..... 340/630; 250/573, 574; 356/439

[56] References Cited

U.S. PATENT DOCUMENTS

| | | | |
|---|---|---|---|
| 3,706,980 | 12/1972 | Maltby | 340/620 X |
| 3,917,956 | 11/1975 | Malinowski | 340/630 X |
| 3,919,702 | 11/1975 | Hayes et al. | 340/630 X |
| 3,982,130 | 9/1976 | Trumble | 340/630 X |
| 4,180,742 | 12/1979 | Malinowski | 340/630 X |
| 4,253,093 | 2/1981 | Johanson et al. | 340/527 X |

FOREIGN PATENT DOCUMENTS

| | | | |
|---|---|---|---|
| 52-10789 | 1/1977 | Japan | 340/630 |
| 2003601 | 3/1979 | United Kingdom | 340/630 |

*Primary Examiner*—John W. Caldwell, Sr.
*Assistant Examiner*—Daniel Myer
*Attorney, Agent, or Firm*—Ladas & Parry

[57] ABSTRACT

A light transmission type smoke detector detecting smoke by sensing attenuation of light beam due to smoke is provided with a first voltage-holding circuit with a smaller time constant and a second voltage-holding circuit with a greater time constant both connected to a photoelectric transducer means; and an output from the photoelectric transducer means, which has sensed the light beam, charges the two voltage-holding circuits. When the photoelectric transducer means detects attenuation of the light beam by smoke, the first voltage-holding circuit holds the output voltage of the photoelectric transducer means for a relatively short time while the second voltage-holding circuit holds the output voltage for a relatively long time. The detector is further provided with a comparing circuit, which compares the output voltage of the first voltage-holding circuit and that of the second voltage-holding circuit and gives an alarm when the output of the first voltage-holding circuit falls lower than that of the second voltage-holding circuit. By means of the above-mentioned mechanism, the detector can compensate the effect of the slow attentuation of light beam caused by some factors other than smoke such as deterioration of the light source or light-receiving element and/or contamination of the optical system, and thus is prevented from mis-alarming.

9 Claims, 2 Drawing Figures

LIGHT TRANSMISSION TYPE SMOKE DETECTOR

TECHNICAL FIELD

This invention relates to a smoke detector of the so-called light transmission type used for monitoring a fire.

BACKGROUND OF THE INVENTION

A light transmission type smoke detector gives a prompt signal at the occurrence of a fire by detecting attenuation of light beam due to smoke coming in a light path provided therein. In light transmission type smoke detectors of the prior art, light attenuation due to smoke existing in the light path and apparent attenuation in light intensity due to aging of the light source, due to degradation in sensitivity of the light-receiving element or due to contamination of lenses and reflecting mirrors in the light path caused by dust or anything else are discriminated by measuring only the degree of light attenuation per time, and thereby prevention of erroneous alarming is intended. In other words, an abrupt change in light intensity caused by smoke generated by a fire and a slow change in light intensity caused by the above mentioned various factors are discriminated only in accordance with light attenuation differentiated by time.

Therefore, when the smoke concentration very slowly increases as in the case of occurrence of a smouldering fire, it is difficult for them to sense absolute smoke concentration and to distinguish the light attenuation due to smouldering from the light attenuation due to other conditions such as referred to above, since there is little or no difference in the light attenuation per unit time therebetween. Therefore, such apparatuses often fail to detect a real fire.

I now have invented a novel light transmission type smoke detector in which the above-mentioned defect is diminished.

DISCLOSURE OF THE INVENTION

This invention provides a light transmission type smoke detector to give an alarm by sensing light attenuation due to smoke comprising: a light source, a photoelectric transducer means arranged to receive the light coming from the light source and to transduce the light into voltage, a first voltage-holding circuit connected to the photoelectric transducer means to receive an output voltage coming from the transducer means and to hold the voltage for a relatively short time, a second voltage-holding circuit connected to the photoelectric transducer means to receive the output voltage coming from the transducer means and to hold the voltage for a relatively long time, and a comparing circuit connected to the first voltage-holding circuit and the second voltage-holding circuit for comparing the output voltage coming from the first voltage-holding circuit with the output voltage coming from the second voltage-holding circuit to generate an output instantly when the output voltage coming from the first voltage-holding circuit falls lower than the output voltage coming from the second voltage-holding circuit.

In another aspect, this invention provides a light transmission type smoke detector as described above which further comprises a level-setting circuit for providing a predetermined voltage level and a second comparing circuit connected to the first voltage-holding circuit and the level-setting circuit for comparing the output voltage coming from the first voltage-holding circuit with the predetermined voltage level coming from the level-setting circuit to generate a separate output when the output voltage coming from the first voltage-holding circuit falls lower than a voltage level predetermined by the level-setting circuit.

In the invention of the present application, an output coming from a photoelectric transducer means which receives light beam from a light source is held in the first voltage-holding circuit with a smaller time constant for a relatively short time to provide a rather rapid response to a voltage applied to said circuit, and the output is also held in a second voltage-holding circuit with a greater time constant for a relatively long time to provide a slow response.

Thus the smoke detector of this invention detects smoke by comparing the output voltage from the first voltage-holding circuit and the output from the second voltage-holding circuit by a comparing circuit and thus give a fire alarm.

In the other aspect of this invention, the smoke detector of this invention gives a fire alarm even when the smoke concentration increases extremely slowly as in the case of a so-called smouldering fire by comparing the output voltage in the first voltage-holding circuit with a level predetermined by the level-setting circuit.

In the smoke detector of this invention, as the light source, light emitting diode, tungsten filament lamp, discharge tube, luminescent diode etc. can be used.

As the photoelectric transducer, which is light-receiving element, too, photodiode, photocell, phototransistor, phototube, photoresistor, etc. can be used. For the time being, photocell is most preferred.

Voltage-holding circuit and comparing circuit per se are known, and many variations will be possible.

As the level-setting circuit, a combination of a resistor and a Zener diode, a combination of two resistors, from the connection point of which an output is obtained, can be used.

Now the invention is described in detail with respect to a specific embodiment with reference to the attached drawings.

DESCRIPTION OF THE PREFERRED EMBODIMENTS

Figure 1:
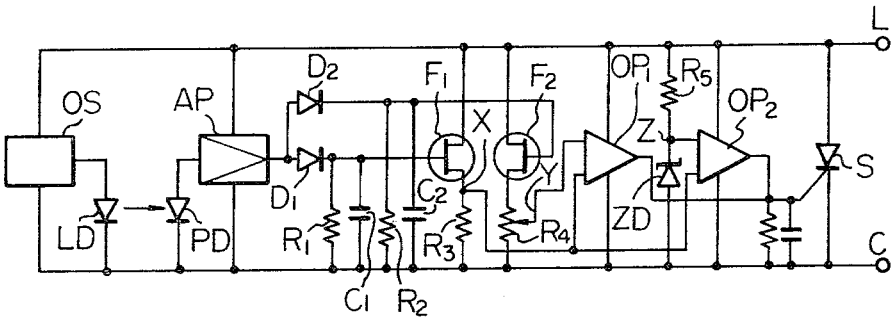
FIG. 1 is a circuit diagram of an embodiment of the light transmission type smoke detector provided in accordance with the invention of the present application.

FIG. 1 illustrates an embodiment of the light transmission type smoke detector of this invention. The smoke detector comprises: a pulse-generating oscillation circuit OS; a light source such as a light-emitting diode LD, which is actuated by the output pulse of said oscillation circuit and emits a light beam into a space where smoke is to be detected; a light-receiving element PD such as a photodiode, which receives the light from said light source LD; an amplifier circuit AP which amplifies signals from said light receiving element PD; a first voltage-holding circuit comprising a diode $D_1$, a resistor $R_1$, a capacitor $C_1$, a field effect transistor $F_1$ and another resistor $R_3$, said first voltage-holding circuit holding the output voltage of the amplifier circuit AP for a short time; a second voltage-holding circuit comprising a diode $D_2$, a resistor $R_2$, a capacitor $C_2$, a field effect transistor $F_2$ and a resistor $R_4$, said second voltage-holding circuit holding the output voltage of the amplifier circuit AP for a longer time; a first comparison circuit $OP_1$ which compares the output voltage of the first voltage-holding circuit and that of the second voltage-holding circuit; a serially connected level-setting circuit comprising a resistor $R_5$ and a Zener diode ZD; a second comparison circuit $OP_2$ which compares the output voltage of the first voltage-holding circuit and the voltage level predetermined by the level-setting circuit; and a silicon controlled rectifier S which is triggered in accordance with either of the outputs of the two comparing circuits $OP_1$ and $OP_2$.

The operation of the smoke detector as represented by FIG. 1 is as follows.

The pulsed light coming from the light source LD impinges upon the light-receiving element PD after passing through the space where smoke is to be detected. The light receiving element PD produces electric signals corresponding to the received light pulses, that is, the transmitted light pulses. The signals are amplified by the amplifier circuit AP and converted into pulsed voltage proportional to the intensity of the transmitted light. The pulsed voltage charges the capacitors $C_1$ and $C_2$ through the diodes $D_1$ and $D_2$ respectively and is held there respectively. Since the relations between the resistors $R_1$ and $R_2$ and the capacitors $C_1$ and $C_2$ are set so as to satisfy a relation $R_1C_1 < R_2C_2$, the first voltage-holding circuit generates output in relatively rapid response to the input voltage from the amplifier circuit, and the second voltage-holding circuit generates output in relatively slow response. In other words, the first voltage-holding circuit holds the output voltage from the amplifier circuit for a shorter time so as to cause a steep change in the output when the input changes rapidly, while the second voltage-holding circuit holds the output voltage from the amplifier circuit for a longer time so as to cause a slow change under the same condition.

Normally, the output of the second voltage-holding circuit is taken out at some position in the middle or halfway of the resistor $R_4$ so that the output voltage X of the first voltage-holding circuit is preset a little higher than the output voltage Y of the second voltage-holding circuit.

In the actual operation, when a fire breaks out and smoke appears in the light path between the light source LD and the light-receiving element PD, the light beam attenuates. Thus the level of the signals generated by the light-receiving element decreases so that the output voltage of the amplifier circuit also decreases. When the smoke concentration increases in a relatively short period of time, the output voltage X of the first voltage-holding circuit falls faster than the output voltage Y of the second voltage-holding circuit as shown in FIG. 2(A), and then the first comparing circuit $OP_1$ generates an output signal to trigger the silicon controlled rectifier S, whereby the terminals L and C are short-circuited and actuates an alarm means, which is not shown in FIG. 1.

Slow light attenuation due to degradation in performance of the light source and the light-receiving element, and/or contamination of lenses, reflecting mirrors causes change in output of the second voltage-holding circuit as well as in that of the first voltage-holding circuit, and therefore, the influence of the above-mentioned deterioration of the light source etc. can be eliminated. This is the first aspect of the invention.

Figure 2:
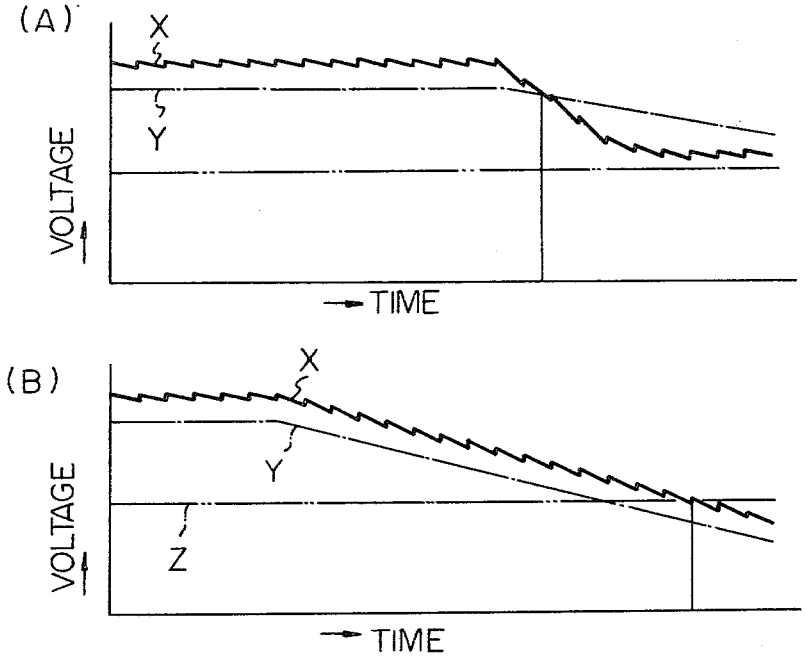
FIG. 2 is a time chart showing the change in the output voltages of the first and the second voltage-holding circuits which is illustrative of the operation of the smoke detector represented by FIG. 1.

When the smoke concentration increases extremely slowly such as in the case of a smouldering fire, the output voltage X of the first voltage-holding circuit and the output voltage Y of the second voltage-holding circuit change almost in parallel, and therefore, the first comparing circuit $OP_1$ does not function as shown in FIG. 2(B). But, if the output voltage X of the first voltage-holding circuit falls lower than a predetermined level Z as shown in FIG. 2(B), that is, the smoke concentration finally reaches the predetermined level, the second comparing circuit $OP_2$ functions and provides a signal to the silicon controlled rectifier S to trigger it, thus the smoke detector gives an alarm.

In the course of time, degradation in performance of the light source and light-receiving element and/or contamination of lenses, mirrors, etc. may become so serious that the light attenuation goes beyond the limit and the smoke detector no longer reliably functions. Then the smoke detector will give an alarm. This means that the smoke detector requires some maintenance service. This is the second aspect of the invention.

In the above-explained specific embodiment, as the light-receiving element or photoelectric transducer, a photodiode is used. However, a photocell is preferred. The light-receiving element or photoelectric transducer can be inserted in the sense opposite to that shown in FIG. 1. Instead of a combination of a resistor and a Zener diode as the level-setting means, a combination of two resistors from the connection point of which the output is taken out. The silicon controlled rectifier can be replaced with a switching circuit having self-maintaining ability.

INDUSTRIAL APPLICABILITY

As has been explained, the light transmission type smoke detector of this invention has ability to compensate the effect of aging of the light source, deterioration of the light-receiving element and/or contamination of lenses and mirrors in the light path and thus to prevent mis-alarming and that can give alarm if the smoke concentration exceeds a predetermined level even when it increases extremely slowly. That is, this invention provides a new smoke detector more reliable than those of the prior art and thus contributes to not only the disaster prevention industry but also the society in general.

I claim:

1. A light transmission type smoke detector to give an alarm by sensing light attenuation due to smoke comprising: a light source, a photoelectric transducer means arranged to receive the light coming from the light source and to transduce the light into voltage, a first voltage-holding circuit connected to the photoelectric transducer means to receive an output voltage coming from the transducer means and to hold the voltage for a relatively short time, a second voltage-holding circuit connected to the photoelectric transducer means to receive the output voltage coming from the transducer means and to hold the voltage for a relatively long time, and a comparing circuit connected to the first voltage-holding circuit and the second voltage-holding circuit for comparing the output voltage coming from the first voltage-holding circuit with the output voltage coming from the second voltage-holding circuit to generate an output instantly when the output voltage coming from the first voltage-holding circuit falls lower than the output voltage coming from the second voltage-holding circuit.

2. The light transmission type smoke detector specified in claim 1 further comprising: a level-setting circuit for providing a predetermined voltage level and a second comparing circuit connected to said first voltage-holding circuit and the level-setting circuit for comparing the output voltage coming from the first voltage-holding circuit with the predetermined voltage level coming from the level-setting circuit to generate an output when the output voltage coming from the first voltage-holding circuit falls lower than the predetermined voltage level coming from the level-setting circuit.

3. The light transmission type smoke detector specified in claim 1 or 2, wherein the light source comprises one of light-emitting diode, tungsten filament lamp and luminescent diode and the photoelectric transducer means comprises one of photodiode, photocell, phototube, phototransistor and photoresistor.

4. The light transmission type smoke detector specified in claim 3, wherein the light source comprises a light emitting diode and the photoelectric transducer means comprises a photocell.

5. The light transmission type smoke detector specified in claim 3, wherein the photoelectric transducer means contains an amplifier circuit.

6. The light transmission type smoke detector specified in claim 1 or 2, wherein the first voltage-holding circuit and the second voltage-holding circuit each comprises a diode, a resistor, a capacitor, a field effect transistor and another resistor.

7. The light transmission type smoke detector specified in claim 1 or 2, wherein the time constant of the second voltage-holding circuit is set to be greater than that of the first voltage-holding circuit.

8. The light transmission type smoke detector specified in claim 2, wherein said level-setting circuit comprises serial connection of a resistor and a Zener diode.

9. The light transmission type smoke detector specified in claim 2, wherein said level-setting circuit comprises a serial connection of two resistors from the interconnecting point of which the predetermined voltage level is taken.

* * * * *